US011332881B2

(12) United States Patent
Gacek et al.

(10) Patent No.: US 11,332,881 B2
(45) Date of Patent: May 17, 2022

(54) FIBER MAT, METHOD OF MAKING THE FIBER MAT, AND BITUMINOUS ROOFING PRODUCT

(71) Applicant: CERTAINTEED CORPORATION, Malvern, PA (US)

(72) Inventors: Matthew Gacek, Rutland, MA (US); Nancy E. Brown, New Braintree, MA (US); Jeffrey H. Peet, Southborough, MA (US); Lucas Giardella, Somerville, MA (US); Tao Yu, Wellesley, MA (US)

(73) Assignee: CERTAINTEED LLC, Malvern, PA (US)

( * ) Notice: Subject to any disclaimer, the term of this patent is extended or adjusted under 35 U.S.C. 154(b) by 168 days.

(21) Appl. No.: 16/238,657

(22) Filed: Jan. 3, 2019

(65) Prior Publication Data

US 2019/0211500 A1 Jul. 11, 2019

Related U.S. Application Data

(60) Provisional application No. 62/614,197, filed on Jan. 5, 2018.

(51) Int. Cl.
*D06N 5/00* (2006.01)
*D06N 3/00* (2006.01)
(Continued)

(52) U.S. Cl.
CPC ..... *D06N 5/003* (2013.01); *D04H 3/12* (2013.01); *D06N 3/0011* (2013.01);
(Continued)

(58) Field of Classification Search
CPC ..... D06N 5/00
See application file for complete search history.

(56) References Cited

U.S. PATENT DOCUMENTS 3,969,171 A 7/1976 Bolen et al.
4,219,603 A 8/1980 Thun
(Continued)

FOREIGN PATENT DOCUMENTS

CA 2553162 A1 7/2005
CA 2210768 C 9/2009
(Continued)

OTHER PUBLICATIONS

European Search Report dated Mar. 27, 2019 in corresponding application EP 19 15 0433, 11 pages.
(Continued)

*Primary Examiner* — Andrew T Piziali
(74) *Attorney, Agent, or Firm* — Abel Schillinger, LLP; Thomas H. Osborn

(57) ABSTRACT

A fiber mat includes an assembly of fibers including a minority portion including a set of polymer fibers and a majority portion including a set of fibers different than the minority portion, wherein the minority portion is a plane parallel to a plane of the majority portion of the assembly of fibers; and a binder including an organic resin, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure.

18 Claims, 3 Drawing Sheets

(51) Int. Cl.
*D04H 3/12* (2006.01)
*E04D 1/20* (2006.01)

(52) U.S. Cl.
CPC ..... *D06N 3/0022* (2013.01); *D06N 3/0036* (2013.01); *E04D 1/20* (2013.01); *D06N 2203/08* (2013.01); *D06N 2211/06* (2013.01)

(56) References Cited

U.S. PATENT DOCUMENTS 4,491,617 A 1/1985 O'Connor et al.
4,780,350 A 10/1988 O-Connor et al.
5,017,426 A * 5/1991 Greiser ..... D04H 1/498 442/85
5,326,797 A 7/1994 Zimmerman et al.
5,571,596 A 11/1996 Johnson
5,612,114 A * 3/1997 Zalewski ..... B32B 5/06 428/102
5,616,395 A 4/1997 Baravian et al.
5,822,943 A 10/1998 Frankoshi et al.
5,837,620 A 11/1998 Kajander
5,851,933 A 12/1998 Swartz et al.
5,865,003 A 2/1999 Klett et al.
5,883,024 A 3/1999 O'Haver-Smith et al.
6,038,826 A 3/2000 Stahl et al.
6,187,697 B1 2/2001 Jaffee et al.
6,341,462 B2 1/2002 Kiik et al.
6,426,309 B1 7/2002 Miller et al.
6,817,152 B2 11/2004 Peng et al.
6,936,329 B2 8/2005 Kilk et al.
7,048,990 B2 5/2006 Koschilzky
7,155,866 B2 1/2007 Bezubic, Jr. et al.
7,285,183 B2 10/2007 Kajander et al.
7,309,668 B2 12/2007 Wilson et al.
7,412,756 B2 * 8/2008 Droux ..... B32B 5/26 28/107
7,827,753 B2 11/2010 Nagarajan et al.
7,833,383 B2 11/2010 Wilson et al.
7,887,900 B2 2/2011 DiPede
7,928,023 B2 4/2011 Canfield et al.
7,932,195 B2 4/2011 Smith et al.
7,998,565 B2 8/2011 Mitsuhashi et al.
8,006,457 B2 8/2011 Binkley et al.
8,012,310 B2 9/2011 Wlson et al.
8,025,765 B2 9/2011 Wilson et al.
8,187,418 B2 5/2012 Kajander et al.
9,297,098 B2 3/2016 Stevens et al.
9,359,523 B2 6/2016 Dubois et al.
2002/0037405 A1 3/2002 Naipawer, III et al.
2003/0008586 A1 * 1/2003 Kajander ..... D04H 1/64 442/327
2003/0092337 A1 * 5/2003 Lehnert ..... D04H 5/02 442/149
2003/0124932 A1 7/2003 Droux
2004/0014385 A1 1/2004 Greaves, Jr. et al.
2004/0144060 A1 7/2004 Becker et al.
2004/0235379 A1 * 11/2004 Ahluwalia ..... B32B 5/18 442/59
2005/0202742 A1 9/2005 Smith et al.
2005/0208861 A1 9/2005 Dwiggins et al.
2006/0099870 A1 5/2006 Garcia et al.
2006/0228963 A1 10/2006 Souther et al.
2007/0012414 A1 1/2007 Kajander et al.
2007/0149078 A1 * 6/2007 Nandi ..... B32B 17/02 442/180
2007/0231545 A1 10/2007 Ruan
2007/0261337 A1 11/2007 Whitaker et al.
2008/0207833 A1 8/2008 Bear et al.
2009/0075050 A1 3/2009 Adzima et al.
2009/0159228 A1 6/2009 Law et al.
2010/0273376 A1 10/2010 Jaffee et al.
2011/0223384 A1 9/2011 Whitaker et al.
2012/0251597 A1 10/2012 Gupta et al.
2013/0025224 A1 1/2013 Vermilion et al.
2014/0259820 A1 9/2014 Humphreys et al.
2015/0240492 A1 8/2015 Teng et al.
2016/0145779 A1 5/2016 Teng et al.
2016/0177483 A1 * 6/2016 Pesquet ..... D04H 13/001 442/1
2017/0182736 A1 * 6/2017 Bergner ..... B32B 5/022
2018/0179758 A1 6/2018 Brown et al.

FOREIGN PATENT DOCUMENTS

CA 2772882 A1 10/2012
CA 2858588 A1 2/2015
CN 2475750 Y 2/2002
CN 1367851 A 9/2002
CN 1307340 C 3/2007
CN 100491664 C 5/2009
CN 103711261 A 5/2014
CN 103802380 A 5/2014
CN 204590426 U 8/2015
CN 103821282 B 1/2017
DE 10111868 A1 10/2002
EP 1447212 A1 8/2004
EP 1746209 A2 1/2007
KR 101328538 B1 11/2013
KR 20140110087 A 9/2014
WO 0108882 A2 2/2001
WO 0708882 A2 2/2001
WO 2012065084 A2 5/2002
WO 2012065903 A1 5/2012
WO 2018119297 A1 6/2018

OTHER PUBLICATIONS

International Search Report and Written Opinion dated Apr. 17, 2018 in corresponding application PCT/US2017/06800, 13 pages.

* cited by examiner

FIBER MAT, METHOD OF MAKING THE FIBER MAT, AND BITUMINOUS ROOFING PRODUCT

CROSS-REFERENCE TO RELATED APPLICATIONS

This application claims priority under 35 U.S.C. § 119(e) to U.S. Provisional Patent Application No. 62/614,197, entitled "A FIBER MAT, METHOD OF MAKING THE FIBER MAT, AND BITUMINOUS ROOFING PRODUCT", by Matthew Gacek, filed Jan. 5, 2018, which is assigned to the current assignee hereof and incorporated herein by reference in its entirety.

FIELD OF THE DISCLOSURE

The present disclosure relates to a fiber mat and in particular, a fiber mat for construction products.

BACKGROUND

Building materials for construction, such as roofing shingles, gypsum wall boards, cement boards, and tiles, are typically constructed with a fiber mat. Chopped strand mat, suitable for use in construction materials, generally includes glass fibers because they are of high strength and tend not to shrink during use. The glass fibers are typically formed by attenuating streams of molten glass material from a bushing. The fibers are drawn from the bushing and the fibers are then chopped directly into a container. The chopped fibers are then dispersed in a water slurry which contains surfactants, viscosity modifiers, dispersants and other chemical agents. The fibers and slurry are agitated to disperse the fibers prior to depositing the mixture onto a moving screen where most of the water is removed. Although this generally describes a wet-laid process, a dry-laid process may be used. A polymeric binder is then applied. After application of the polymeric binder, the resulting mat is heated to remove the remaining water and cure the binder.

Important properties for a fiber mat include caliper, tensile strength, and tear strength. These properties are useful in determining the efficacy of the manufacture of fiber mat products and final properties of the fiber mat. Unfortunately, as tensile strength of the fiber mat increases, the tear strength of a bituminous roofing product containing the fiber mat typically decreases. As such, modifications to the fiber mats to improve tear strength while maintaining tensile strength are desired.

Accordingly, a need continues to exist in the art for improved fiber mats.

SUMMARY

In an embodiment, a fiber mat includes an assembly of fibers including a minority portion including a set of polymer fibers and a majority portion including a set of fibers different than the minority portion, wherein the minority portion is a plane parallel to a plane of the majority portion of the assembly of fibers; and a binder including an organic resin, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure.

In another embodiment, a method of making a fiber mat includes providing an assembly of fibers including a minority portion including a set of polymer fibers and a majority portion including a set of fibers different than the minority portion, wherein the minority portion is a plane parallel to a plane of the majority portion of the assembly of fibers; applying a binder to the assembly of fibers, wherein the binder includes an organic resin; and curing the binder, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure.

In yet another embodiment, a bituminous roofing product includes a fiber mat including an assembly of fibers including a minority portion including a set of polymer fibers and a majority portion including a set of fibers different than the minority portion, wherein the minority portion is a plane parallel to a plane of the majority portion of the assembly of fibers; and a binder including an organic resin, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure; and at least one coating of asphalt.

BRIEF DESCRIPTION OF THE DRAWINGS

Embodiments are illustrated by way of example and are not limited in the accompanying figures.

Figure 1:
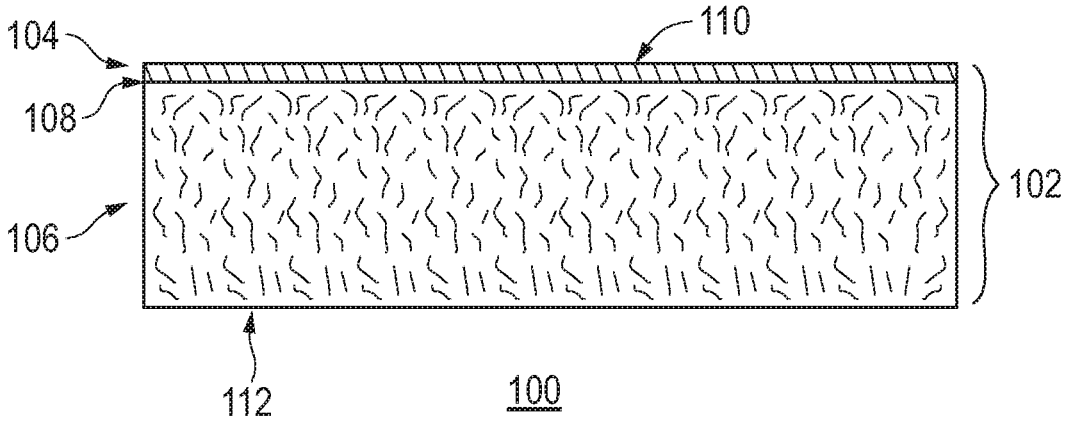
FIG. 1 includes a cross-sectional view of an exemplary fiber mat.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises", "comprising", "includes", "including", "has", "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

In an embodiment, the present invention provides a fiber mat. The fiber mat includes an assembly of fibers and a binder including an organic resin. The assembly of fibers includes a minority portion including a set of polymer fibers and a majority portion including a set of fibers different than the minority portion. A "minority portion" refers to a portion of the fiber mat that is less than 10% of the total composition of fiber mat. A "majority portion" refers to a portion of the fiber mat that is greater than 90% of the total composition of the fiber mat. In a particular embodiment, an air permeability of said fiber mat is not substantially different from an equivalent weight fiber mat containing a homogenous mat structure. Advantageously, the fiber mat provides at least a 5% increase in tear when used in a bituminous roofing product, compared to an equivalent bituminous roofing product made with an equivalent weight fiber mat containing a homogenous mat structure. "A homogenous mat structure" as used herein refers to a fiber mat that is homogenous in fiber distribution throughout the entirety of the mat. For instance, even if different fibers are used in the homogenous mat, the fibers are homogenously blended throughout the entirety of the mat. A "bituminous roofing product" as used herein includes the fiber mat and at least one coating of asphalt.

The "assembly of fibers" as discussed herein refers to an assembly of fibers that are integrally intertwined through at least a portion of a thickness of the fiber mat. In an embodiment, the set of polymer fibers is integrally intertwined in the minority portion. Further, the set of fibers of the majority portion is integrally intertwined in the majority portion. In a particular embodiment, the minority portion is a plane parallel to a plane of the majority portion. The minority portion is in direct contact with the majority portion at an interface. Although the set of polymer fibers is integrally intertwined in the minority portion and the set fibers of the majority portion are integrally intertwined, the interface has a substantially distinct segregation between the minority portion and the majority portion. For instance, there is substantially minimum fiber entanglement at the interface between the minority portion and the majority portion. "Substantially minimum fiber entanglement" at the interface is defined as a portion of the fiber mat having not greater than 5% thickness, such as not greater than 4% thickness, such as not greater than 3% thickness, or even not greater than 2% thickness of the total thickness of the mat where there is entanglement of the fibers between the majority portion and the minority portion.

The minority portion includes a set of polymer fibers and the majority portion includes a set of fibers different than the set of polymer fibers for the minority portion. Any polymer fiber for the minority portion is envisioned. In an embodiment, the polymer fibers have a melting temperature ($T_m$) greater than about 200° C., such as greater than about 205° C. In a particular embodiment, the polymer fiber includes, for example, polyester, polyethylene terephthalate, polyvinyl alcohol (PVA), polyvinyl chloride (PVC), polyether ether ketone (PEEK), polyether ketone (PEK), polyacrylonitrile, polystyrene, nylon, polymethyl methacrylate (PMMA), polybenzimidazole (PBI), polyimide, polyether imide (PEI), polyamide-imide (PAI), polyether sulfone (PES), polyphenyl sulfone (PPSU), polyphenylsulfide (PPS), liquid crystal polymer (LCP), ethylene tetrafluoroethylene (ETFE), polytetrafluoroethylene (PTFE), perfluoroalkoxy alkane (PFA), a blend, or combination thereof. The polymer fiber may further be blended with a natural fiber, such as a basalt fiber, an animal-based fiber, a plant-based fiber, or combination thereof. In an embodiment, the polymer fiber consists essentially of polyethylene terephthalate fiber. In a more particular embodiment, the polymer fiber consists of polyethylene terephthalate fiber.

In a particular embodiment, the polymer fiber can be any length such as continuous strand, chopped, or combination thereof. In a more particular embodiment, the polymer fiber of the minority portion is chopped into a suitable length to provide a substantially random orientation of fibers. Any reasonable length of fibers is envisioned. Generally, the polymer fiber has a length of about 0.25 inches to about 3 inches, such as about 0.25 inches to about 2 inches, or even about 0.25 inches to about 1 inch. In an embodiment, any reasonable diameter of the polymer fiber is envisioned. For instance, a diameter of at least about 3 microns, such as about 3 microns to about 50 microns, such as about 3 microns to 20 microns, such as at least about 11 microns, such as about 13 microns, or even 16 microns are used. In a particular embodiment, the polymer fiber has a diameter of about 11 microns to about 16 microns. Although generally described as a diameter, one skilled in the art would understand that the diameter includes a major axis of the polymer fiber if a cross-section is circular or non-circular. In an embodiment, any reasonable denier of the polymer fiber is envisioned. For instance, the polymer fiber has a denier of about 1 to about 10, such as about 1 to about 7, such as about 2 to 7, such as about 2 to about 5, or even about 3 to about 5.

As discussed, the minority portion refers to a portion of the fiber mat that is less than 10% of the total composition of fiber mat. In an embodiment, the minority portion includes any reasonable amount of the polymer fibers. In a particular embodiment, the polymer fibers are present at an amount of about 0.5 weight % to about 10 weight %, such as about 1 weight % to 5 weight %, such as about 1 weight % to about 3 weight % of the total weight of the assembly of fibers of the fiber mat. It has been discovered that a minority portion of polymer fibers within the fiber mat provides a substantial increase in tear when used in a bituminous roofing product using a minimal amount of polymer fibers. In particular, the minority portion provides at least a 5% increase in tear when used in a bituminous roofing product, compared to an equivalent bituminous roofing product made with a fiber mat of equivalent weight containing a homogenous mat structure.

The majority portion of the fiber mat includes a set of fibers different than the set of polymer fibers for the minority portion. Any configuration of providing the different set of fibers of the majority portion from the set of polymer fibers of the minority portion is envisioned. For instance, the polymer fibers of the minority portion may be different from the set of fibers for the majority portion in composition, length, diameter, amount, or any combination thereof. The set of fibers for the majority portion can have a composition that includes a variety of suitable materials. For instance, the set of fibers for the majority portion can include a glass fiber, such as a fiber made from A-type glass fiber, a C-type glass fiber, an E-type glass fiber, an S-type glass fiber, an E-CR-type glass fiber, a wool glass fiber, a polymer fiber, a mineral fiber, a natural fiber such as a basalt fiber, a blend, or a combination thereof. In a particular embodiment, the set of fibers for the majority portion are glass fiber. In an embodiment, the set of fibers for the majority portion consists essentially of glass fiber. In a more particular embodiment, the set of fibers for the majority portion consists of glass fiber. In an alternative embodiment, the set of fibers for the majority portion may be a polymer fiber with the proviso of being different than the polymer fiber of the minority portion.

In a particular embodiment, the set of fibers for the majority portion can be any length such as continuous strand, chopped, or combination thereof. In a more particular embodiment, the fiber for the majority portion is chopped into a suitable length to provide a substantially random orientation of fibers. Any reasonable length of fibers is envisioned. Generally, the fiber for the majority portion has a length of about 0.25 inches to about 3 inches, such as about 0.25 inches to about 2 inches, or even about 0.25 inches to about 1 inch. In an embodiment, any reasonable diameter of the fiber for the majority portion is envisioned. For instance, a diameter of at least about 3 microns, such as about 3 microns to about 50 microns, such as about 3 microns to 20 microns, such as at least about 11 microns, such as about 13 microns, or even 16 microns are used. In a particular embodiment, the fiber for the majority portion has a diameter of about 11 microns to about 16 microns. Although generally described as a diameter, one skilled in the art would understand that the diameter includes a major axis of the fiber if a cross-section is circular or non-circular.

The majority portion of the fiber mat is greater than 90% of the total composition of the fiber mat. The majority portion may contain any reasonable amount of fibers. In particular, the set of fibers for the majority portion are present at about 90 weight % to about 99.5 weight %, such as about 95 weight % to 99 weight %, such as about 97 weight % to about 99 weight % of the total weight of the assembly of fibers, with the proviso that the total weight % of the fibers for the majority portion and the polymer fibers for the minority portion equals 100%.

Any position of the minority portion within the fiber mat is envisioned. Particularly, the minority portion has a center plane that is a plane parallel to an x-axis of the total fiber mat. In an embodiment, the center plane of the minority portion is closer in distance to one surface of the fiber mat. When the minority portion is closer to one surface of the fiber mat, the fiber mat has asymmetrical flexibility. In an embodiment the minority portion is closer to the top surface of the fiber mat. In another embodiment, the minority portion is closer to the bottom surface of the fiber mat. In an embodiment, the minority portion provides the top surface of the fiber mat and the majority portion provides the bottom surface of the fiber mat. In an embodiment, the minority portion is sandwiched between the majority portion. In an example, the minority portion is sandwiched between the majority portion and the center plane of the minority portion is closer in distance to at least one surface of the fiber mat. In an example, the center plane of the minority portion is approximately coincident to a center plane of the fiber mat, such as located in the middle of the fiber mat in a vertical plane (y-axis), i.e. equidistant from a top surface of the fiber mat and a bottom surface of the fiber mat. When the minority portion is in the middle of the fiber mat, the fiber mat has symmetrical flexibility.

In an embodiment, the minority portion and the majority portion each provides advantageous properties. The minority portion and the majority portion can be configured to custom tailor the fiber mat and its properties. In particular, each portion provides advantageous properties to the final mat as well as the final product, such as a bituminous roofing product. For instance, the majority portion provides the majority of tensile strength to the fiber mat with the minority portion providing an advantageous tensile strength that does not decrease with the use of a polymer fiber. Typically, with a homogenous blended mat where a polymer fiber and a glass fiber are both used, the addition of the polymer fiber can decrease the tensile strength of the fiber mat. With the minority portion and the majority portion of the present invention, the tensile strength of the fiber mat is not adversely affected. Further, when the fiber mat is used in a bituminous roofing product, the majority portion provides the majority of tear strength, however, the minority portion of the fiber mat provides a substantial benefit to tear strength of the bituminous roofing product, particularly unexpected at the amount of polymer fiber used when compared to a homogenous blended fiber mat having an equivalent amount of polymer fiber. The properties of tear strength and tensile strength are typically coupled inversely with a homogenous mat structure. Although not being bound by theory, by forming a fiber mat with a minority portion that is different than a majority portion, the properties of tear strength and tensile strength can be selectively decoupled to tailor and achieve both desirable tear strength and tensile strength, particularly when the fiber mat is used in a bituminous roofing product.

The fiber mat includes a binder used to fixedly bond the assembly of fibers. The binder is a composition that includes any suitable organic resin. The organic resin can include one or more suitable monomers, oligomers, polymers, copolymers, a suitable blend, or combination thereof. In a particular embodiment, the organic resin is any reasonable resin envisioned for fiber mat applications. In an embodiment, the organic resin includes one or several of a urea-formaldehyde composition, a latex composition, an acrylic composition, a styrene-butadiene rubber (SBR) composition, a vinyl acetate ethylene composition, a blend or combination thereof. In a particular embodiment, the organic resin includes a urea-formaldehyde composition, a latex composition, or combination thereof. In an embodiment, the latex is present at an amount of up to about 5% by weight, such as up to about 7% by weight, or even up to about 100% by weight, based on the total weight % of the first binder composition. In an embodiment, the organic resin may be a photocurable polymer. Further, any form of the binder may be envisioned such as a liquid, a powder, or any combination thereof.

The composition of the binder may also contain a variety of other known additives such as an adhesion promoter to enhance the adhesion of the binder to the fiber mat to increase the bonding strength between the assembly of fibers, a silica colloid to enhance fire resistance, antifoamers, biocides, pigments, the like, or combinations thereof. In an embodiment, the binder can include less than about 25% by weight of additives, based on the total weight of the binder composition. In another embodiment, the binder is substantially free of additives. "Substantially free" as used herein refers to less than about 1% by weight of additives, less than about 0.5% by weight of additives, or even less than about 0.1% by weight of additives, based on the total weight of the binder composition. Any amount of total binder on the fiber mat is envisioned but it will usually be found convenient and satisfactory to make up the total binder in the range from about 5% by weight to about 50% by weight, such as about 10% by weight to about 40% by weight, such as about 10% by weight to about 30% by weight of the cured fiber mat. In an embodiment, the binder is substantially uniformly distributed throughout the fiber mat. "Substantially uniformly distributed" as used herein refers to a varying binder concentration of not greater than 5%, such as not greater than 4%, such as not greater than 3%, such as not greater than 2%, or even not greater than 1% from the top surface to the bottom surface of the fiber mat. In an alternative embodiment, the binder concentration or composition in the minority portion is different than the majority portion.

Any method of providing the fiber mat of the present invention is envisioned and depends upon the final properties desired for the mat. An exemplary method of forming a fiber mat in accordance with the present invention begins with an assembly of fibers, such as chopped bundles of fibers of suitable length. An exemplary method of making the fibers mat includes providing the assembly of fibers, such as separately providing the majority portion and the minority portion. The set of polymer fibers for the minority portion and the different set of fibers for the majority portion may be provided by any reasonable means or sequence. For instance, the set fibers for the majority portion are first provided with the set of polymer fibers of the minority portion subsequently provided. In an embodiment, the set of polymer fibers of the minority portion is sandwiched between the set of fibers for the majority portion. Any method of providing the minority set of polymer fibers and the majority set of fibers is envisioned, with the proviso that there is substantially minimum fiber entanglement at the interface. Although primarily described as an assembly of fibers including a minority portion of the set of polymer fibers and a majority portion of a different set of fibers, any number of sets of fibers is envisioned.

Typically, the assembly of fibers is added to a dispersant medium to form an aqueous slurry, known in the art as "white water". The white water typically contains fibers, dispersant(s), viscosity modifier(s), foam control and biocide additives. The fibrous slurry is then agitated to form a workable, uniform dispersion of fibers having a suitable consistency. The dispersant may contain polyacrylamide, hydroxyethyl cellulose, and other additive such as surfactants, lubricants, defoamers, the like, or combinations thereof.

The assembly of fibers and white water dispersion is then passed onto a mat-forming machine containing a mat forming screen. The dispersion is usually diluted with water to a lower fiber concentration prior to being dispersed on a screen. The fibers are collected at the screen in the form of a wet fiber mat, and the excess water is removed by gravity or, more preferably, by vacuum in a conventional manner, such as by vacuum boxes. Although this generally describes a wet-laid process, a dry-laid process may also be envisioned. For instance, with a dry-laid process, fibers may be spun from a bushing directly onto a moving web. The binder is subsequently applied.

Any method of providing the binder is envisioned. The binder is traditionally applied to the gravity- or vacuum-assisted de-watered white fiber mat. Applying the binder includes at least one application of the binder on the assembly of fibers. Application of the binder may be accomplished by any conventional means, such as by soaking the mat in an excess of binder solution, or by coating the mat surface by means of a binder applicator such as a sprayer, roll, or curtain. Other methods include, for example, applying as a film, a slot die, or any reasonable extrusion method. The components of the binder may be applied separately or mixed together by any method envisioned. For instance, if applied separately, the components of the binder may be added by the same or a different method. In an embodiment, any other sequence of adding the components of the binder is envisioned. The total concentration of components in the binder in an aqueous solution can vary widely in accordance with the practice of the present invention.

Following application of the binder, the fiber mat is de-watered by any reasonable means, such as under vacuum, to remove excess binder solution. In an embodiment, the mat is dried prior to cure. Any method of drying the fiber mat is envisioned. In a particular embodiment, the drying is at a temperature wherein the fiber mat does not reach the cure temperature of the binder and is dependent upon the binder composition chosen. For instance, drying is with forced heated air, such as a convection oven, a gas fired oven, an infrared heater, a heated drum, a belt laminator, photoinitiation, ultraviolet (UV) initiation, or combination thereof. In an exemplary embodiment, at least about 95%, such as at least about 90%, or even at least about 80% of water weight of the aqueous binder is removed during the drying process. In an embodiment, the binder is partially cured during the drying step, with a cure of not greater than a 50%, as measured by a ratio of dry tensile strength to tensile strength of a wet fiber mat subjected to 10 minutes exposure to 80° C. hot water.

Although primarily described as a single binder and a single application of binder, any number of binder compositions, applications of binder, or combination thereof is envisioned. If there is more than one application of the binder, any subsequent applications of binder may be, for example, the binder or a second binder. Any sequence of providing and curing the binder and any second binder is envisioned.

In an embodiment, the cure of the binder is facilitated with heat provided by any reasonable means. Any heat source is envisioned and includes, for example, oven, infrared heating, heating with a metal plate in contact with the fiber mat, and the like. Any reasonable time and temperatures is envisioned and is dependent upon the binder composition and the desired process speed. In an embodiment, heat treatment is sufficient to effect curing. In an embodiment, catalytic curing may also be used. In an embodiment, dimensional constraint may be applied to the fiber mat during cure. Although cure is primarily described as via a heat treatment, any other method is reasonable, such as, for example, ultraviolet cure.

Although an exemplary method is described, any sequence of providing any fiber and any binder is envisioned, depending on the composition of the minority portion, the composition of the majority portion, and the final properties desired for the fiber mat. For instance, although described as providing the binder on the assembly of fibers, the binder may provided on the minority portion, the majority portion, or combination thereof in any sequence and method envisioned.

Typically, the fiber mat can have any caliper desired. In an example, the caliper at 1.8 pounds (lbs) per 100 square feet is at least about 5 mil, such as about 5 mil to about 200 mil, such as about 10 mil to about 75 mil, such as about 10 mil to about 40 mil, such as about 10 mil to about 30 mil, such as about 10 mil to about 25 mil. In an example, the caliper of the fiber mat is not greater than about 200 mil, such as not greater than about 100 mil, such as not greater than 50 mil.

Turning to FIG. 1, a cross-sectional view of a portion of an exemplary fiber mat 100 is illustrated. The fiber mat 100 includes an assembly of fibers 102 where the assembly of fibers 102 includes a binder thereon (not shown). The minority portion 104 includes a set of polymer fibers and is a smaller portion of the assembly of fibers 102 than the majority portion 106. The majority portion 106 includes a set of fibers different than the set of polymer fibers of the minority portion 104. The minority portion 104 is directly in contact with the majority portion 106 at the interface 108. At the interface 108, there is substantially minimum fiber entanglement between the minority portion 104 and the majority portion 106. Notably, the gradient difference between the minority portion 104 and the majority portion 106 is relatively steep and for an asymmetrically located minority portion this will be reflected by a large flexural stiffness difference between the two sides of the fiber mat 100. Further and as seen in FIG. 1, the minority portion 104 is a plane parallel to an x-axis and a plane of the majority portion 106 of the assembly of fibers 102. Additionally, although the minority portion 104 is illustrated as closer to a top surface 110 than a bottom surface 112 of the fiber mat 100, any position of the minority portion 104 is envisioned and is dependent upon the final properties desired for the fiber mat 100.

Any one or more suitable components are envisioned for the fiber mat depending upon the final product and properties desired. For instance, the fiber mat may be coated with a polymer film coating. Any reasonable polymer film coating is envisioned. Typically, the polymer film coating chosen is dependent upon the final properties desired for the construction product. In an embodiment, the polymer film coating includes a latex, an ethylene methyl acrylate, ethylene vinyl acetate, polyethylene terephthalate, polyamide, hot melt adhesive, fluoropolymer, polyolefin, or combination thereof. The method of applying the polymer film coating is dependent upon the material. Any method is envisioned such as coating, extruding, spraying, or laminating. For instance, a polymer film coating may be extruded directly onto the fiber mat without any intervening layers. In another embodiment, a polymer film coating may be laminated, with or without an adhesive, onto the fiber mat.

In an example, the polymer film coating can be provided on the fiber mat and can be positioned on any portion of the fiber mat desired. In an embodiment, the polymer film coating can partially or substantially coat at least one surface the fiber mat. In an embodiment, the polymer film coating can partially coat at least two surfaces of the fiber mat. In a particular embodiment, the polymer film coating can substantially coat the fiber mat and can penetrate the fiber mat. The polymer film coating can also include more than one layer on the fiber mat, each of which can be allowed to set, harden, dry, or otherwise cure before any additional layers of polymer film coating are applied. The polymer film coating can include any suitable thickness such as at least about 5 microns, or range of thicknesses, such as between about 5 microns and about 300 microns.

In an embodiment, the fiber mat can include one component such as a nonwoven laid scrim. In another embodiment, the fiber mat can include more than one component, such as one or more scrims, either woven or nonwoven, suitably coupled to one or more mats, either woven or nonwoven. For example, a woven scrim including glass fibers can be coupled to the nonwoven mat. In an embodiment, the fiber mat does not include any additional component.

The fiber mat as described has advantageous and unexpected properties. The fiber mat of the present invention has desirable properties such as tensile strength. For instance, the fiber mat has a tensile strength at least 80% of a value of tensile strength of a fiber mat of equivalent weight containing a homogenous mat structure. Further, the fiber mat has a tensile strength at least 80% of a value of tensile strength of a higher caliper fiber mat having a homogenous mat structure. In an embodiment, the fiber mat has desirable tensile strength, such as a dry tensile strength of about 50 N/inch to about 400 N/inch, such as about 100 N/inch to about 400 N/inch, or even about 100 N/inch to about 200 N/inch.

The fiber mat of the present invention has desirable properties such as tear strength, particularly when the fiber mat is used in a bituminous roofing product. As stated earlier, the fiber mat provides at least a 5% increase in tear strength, such as at least a 10% increase in tear strength, such as at least a 15% increase in tear strength, or even at least a 20% increase in tear strength, when placed in a bituminous roofing product compared to an equivalent bituminous roofing product made with a fiber mat of equivalent weight containing a homogenous mat structure. Further, a bituminous roofing product including the fiber mat has a tear strength at least 80% of a value of tear strength of an equivalent bituminous roofing product comprising a higher caliper fiber mat having a homogenous mat structure. In an embodiment, a bituminous roofing product containing the fiber mat has a desirable tear strength, such as a tear strength of about 1200 grams to about 3000 grams, such as about 1600 grams to about 2600 grams, or even about 2000 grams to about 2600 grams for a representative shingle weight of approximately 4,650 g/m$^2$ (i.e. 95 lbs/100 ft$^2$) containing a fiber mat of approximately 100 g/m$^2$ (i.e. 2 lbs/100 ft$^2$). In a more particular embodiment, the fiber mat of the present invention achieves both desirable tensile strength and tear strength, particularly when used in a bituminous roofing product.

The fiber mat as described above can be provided in any suitable manner to provide for a construction product. Any construction product is envisioned where tensile strength, tear strength, air and liquid permeability, flexural strength, conformability, surface roughness, flatness, etcetera are desired. An exemplary construction product includes, for example, a bituminous roofing product, a gypsum wall board, a cement board, a PVC flooring, a rug backing, a tile backing, an insulation facer, a foam facer, a ceiling tile, etcetera, and the like. In an embodiment, the fiber mat can also be used as, composite gypsum building panels, gypsum fiber building panels, cement board, fibrous cement boards, gypsum fiber siding, fibrous cement siding, cement siding, gypsum cove or cornice, fibrous gypsum cove and cornice, cement cove and cornice, fibrous cove and cornice, magnesium oxide building boards, magnesium oxide cove and cornice, magnesium oxide siding, magnesium oxide shingles, asphalt impregnated shingles, asphalt coated shingles, asphalt impregnated building wraps, organic polymer coated, inorganic coated building wraps, organic/inorganic blended coated building wraps, composite siding, tapes incorporating continuous or non-continuous or blended continuous and non-continuous (mats, scrims, tissues, fabrics) materials, corner bead, carpet, reinforced plywood, reinforced layered polymer composites, and reinforced molded or extruded organic or inorganic or blended organic and inorganic materials (including reinforced geometrical substrates, reinforced rigid or flexible plastic tubing, and reinforced cylinders).

In an embodiment, the construction product is a bituminous roofing product. The fiber mat can be provided in the cementitious product to provide structural integrity to the resulting bituminous roofing product. The fiber mat may be situated in any suitable configuration within the bituminous roofing product. In a typical embodiment, the fiber mat is coated with at least one layer of asphalt. For example, the fiber mat can be produced as described above and then coated with at least one layer of asphalt. In an embodiment, the fiber mat is coated with at least one layer of asphalt on both the top surface and the bottom surface. Alternatively, the fiber mat can be produced simultaneously or concurrently while it is being coupled to a bituminous roofing product. In an embodiment, at least a portion of the fiber mat can be embedded to any suitable depth from a surface or edge of the bituminous roofing product. In an embodiment, the asphalt substantially impregnates a plurality of interstices between the assembly of fibers. For instance, both the majority portion and the minority portion of the fiber mat have desirable air permeability to allow impregnation of the asphalt into the fiber mat. In an embodiment, the fiber mat has an air permeability of at least 750 CFM/ft$^2$. In a particular embodiment, the bituminous roofing product is a roofing shingle. In an embodiment, the bituminous roofing product has a weight of at least about 160 pounds/100 square feet, such as about 175 pounds/100 square feet to about 250 pounds/100 square feet, such as about 200 pounds/100 square feet to about 250 pounds/100 square feet.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1

A fiber mat includes: an assembly of fibers including a minority portion including a set of polymer fibers and a majority portion including a set of fibers different than the minority portion, wherein the minority portion is a plane parallel to a plane of the majority portion of the assembly of fibers; and a binder including an organic resin, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure.

Embodiment 2

A method of making a fiber mat includes: providing an assembly of fibers including a minority portion including a set of polymer fibers and a majority portion including a set of fibers different than the minority portion, wherein the minority portion is a plane parallel to a plane of the majority portion of the assembly of fibers; applying a binder to the assembly of fibers, wherein the binder includes an organic resin; and curing the binder, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure.

Embodiment 3

A bituminous roofing product includes a fiber mat including an assembly of fibers including a minority portion including a set of polymer fibers and a majority portion including a set of fibers different than the minority portion, wherein the minority portion is a plane parallel to a plane of the majority portion of the assembly of fibers; and a binder including an organic resin, wherein an air permeability of said fiber mat is not substantially different from an equivalent weight fiber mat containing a homogenous mat structure and wherein the fiber mat provides at least a 5% increase in tear when placed in a bituminous roofing product compared to an equivalent bituminous roofing product made with the equivalent weight fiber mat containing the homogenous mat structure; and at least one coating of asphalt.

Embodiment 4

The fiber mat, the method, or the bituminous roofing product of any of the preceding embodiments, wherein the fiber mat has an air permeability of at least 750 CFM/ft$^2$.

Embodiment 5

The fiber mat, the method, or the bituminous roofing product of any of the preceding embodiments, wherein the polymer fibers have a melting temperature ($T_m$) greater than about 200° C.

Embodiment 6

The fiber mat, the method, or the bituminous roofing product of embodiment 5, wherein the polymer fibers include polyester, polyethylene terephthalate, polyvinyl alcohol (PVA), polyvinyl chloride (PVC), polyether ether ketone (PEEK), polyether ketone (PEK), polyacrylonitrile, polystyrene, nylon, polymethyl methacrylate (PMMA), polybenzimidazole (PBI), polyimide, polyether imide (PEI), polyamide-imide (PAI), polyether sulfone (PES), polyphenyl sulfone (PPSU), polyphenylsulfide (PPS), liquid crystal polymer (LCP), ethylene tetrafluoroethylene (ETFE), polytetrafluoroethylene (PTFE), perfluoroalkoxy alkane (PFA), a blend, or combination thereof.

Embodiment 7

The fiber mat, the method, or the bituminous roofing product of embodiment 6, wherein the polymer fibers include polyethylene terephthalate.

Embodiment 8

The fiber mat, the method, or the bituminous roofing product of embodiment 7, wherein the polyethylene terephthalate has a denier of about 1 to about 10, such as about 2 to about 7, such as about 3 to about 5.

Embodiment 9

The fiber mat, the method, or the bituminous roofing product of any of the preceding embodiments, wherein the polymer fibers are present at an amount of about 0.5 weight % to about 10 weight %, such as about 1 weight % to 5 weight %, such as about 1 weight % to about 3 weight % of the total weight of the assembly of fibers.

Embodiment 10

The fiber mat, the method, or the bituminous roofing product of any of the preceding embodiments, wherein the minority portion is directly in contact with the majority portion at an interface, wherein the interface has a substantially distinct segregation between the minority portion and the majority portion.

Embodiment 11

The fiber mat, the method, or the bituminous roofing product of any of the preceding embodiments, wherein a center plane of the minority portion is closer in distance to one surface of the fiber mat.

Embodiment 12

The fiber mat, the method, or the bituminous roofing product of embodiment 11, wherein the fiber mat has an asymmetric flexibility.

Embodiment 13

The fiber mat, the method, or the bituminous roofing product of embodiment 11, wherein the minority portion is sandwiched between the majority portion.

Embodiment 14

The fiber mat, the method or the bituminous roofing product of embodiments 1-10, wherein a center plane of the minority portion is approximately coincident to a center plane of the fiber mat.

Embodiment 15

The fiber mat, the method, or the bituminous roofing product of any of the preceding embodiments, wherein the minority portion includes a substantially random orientation of chopped fibers.

Embodiment 16

The fiber mat, the method, or the bituminous roofing product of any of the preceding embodiments, wherein the majority portion includes a substantially random orientation of chopped fibers.

Embodiment 17

The fiber mat, the method, or the bituminous roofing product of any of the preceding embodiments, wherein the set of fibers of the majority portion includes a glass fiber, a polymer fiber, a basalt fiber, a mineral fiber, or combination thereof.

Embodiment 18

The fiber mat, the method, or the bituminous roofing product of embodiment 17, wherein the glass fiber includes an A-type glass fiber, a C-type glass fiber, an E-type glass fiber, an S-type glass fiber, an E-CR-type glass fiber, a wool glass fiber, or a combination thereof.

Embodiment 19

The fiber mat, the method, or the bituminous roofing product of any of the preceding embodiments, wherein the binder is substantially uniformly distributed throughout the fiber mat.

Embodiment 20

The fiber mat, the method, or the bituminous roofing product of any of the preceding embodiments, wherein a total binder is about 5% by weight to about 50% by weight of the cured fiber mat.

Embodiment 21

The fiber mat, the method, or the bituminous roofing product of any of the preceding embodiments, wherein the organic resin includes a urea-formaldehyde composition, a latex composition, a styrene-butadiene rubber (SBR) composition, a vinyl acetate ethylene composition, a blend or combination thereof.

Embodiment 22

The fiber mat, the method, or the bituminous roofing product of any of the preceding embodiments, wherein the fiber mat has a tensile strength at least 80% of a value of tensile strength of a fiber mat of equivalent weight containing a homogenous mat structure.

Embodiment 23

The fiber mat, the method, or the bituminous roofing product of any of the preceding embodiments, wherein the fiber mat has a tensile strength at least 80% of a value of tensile strength of a higher caliper fiber mat having a homogenous mat structure.

Embodiment 24

The fiber mat, the method, or the bituminous roofing product of any of the preceding embodiments, wherein a bituminous roofing product including the fiber mat has a tear strength at least 80% of a value of tear strength of an equivalent bituminous roofing product comprising a higher caliper fiber mat having a homogenous mat structure.

Embodiment 25

The fiber mat, the method, or the bituminous roofing product of any of the preceding embodiments, wherein the fiber mat has a caliper at 1.8 pounds per 100 square feet of about 10 mil to about 40 mil.

Embodiment 26

The method of any of the preceding embodiments, wherein providing the assembly of fibers includes providing the set of fibers of the majority portion and subsequently providing the set of polymer fibers of the minority portion.

Embodiment 27

The fiber mat or method of any of the preceding embodiments, wherein the fiber mat is used as a reinforcement for a construction product.

Embodiment 28

The fiber mat or method of embodiment 27, wherein the construction product includes a bituminous roofing product.

Embodiment 29

The fiber mat or method of embodiment 28, wherein the bituminous roofing product includes a roofing shingle.

Embodiment 30

The bituminous roofing product of any of the preceding embodiments, wherein the asphalt substantially impregnates a plurality of interstices between the assembly of fibers.

Embodiment 31

The bituminous roofing product of any of the preceding embodiments, having a weight of at least about 160 pounds/100 square feet, such as about 175 pounds/100 square feet to 250 pounds/100 square feet.

The following examples are provided to better disclose and teach processes and compositions of the present invention. They are for illustrative purposes only, and it must be acknowledged that minor variations and changes can be made without materially affecting the spirit and scope of the invention as recited in the claims that follow.

EXAMPLES

Example 1

Hand sheets are constructed in the lab to a fiber weight of 1.46 lbs/100 $ft^2$ and then 0.39 lbs/100 $ft^2$ of binder is added to create a 21% LOI hand sheet with a total weight of 1.85 lbs/100 $ft^2$. In a normal hand sheet, all of the fibers are glass, but in this Example, part of the glass weight is substituted with polyethylene terephthalate (PET) fibers. In this Example, the PET is homogenously blended with the glass to form the hand sheet.

To form a shinglet, the hand sheet is stapled to a release liner substrate. Asphalt and filler are heated to 205° C. and mixed together. The asphalt is knife coated onto the hand sheet. The asphalt is allowed to cool and then the partially coated hand sheet is removed from a release liner. The partially coated hand sheet is flipped over to expose the uncoated side and the hand sheet is stapled down to the release liner substrate again. Fresh asphalt and filler is heated to 205° C. and mixed together. The asphalt is knife coated onto the partially coated hand sheet to form a fully coated hand sheet, i.e. shinglet (hand sheet should be encapsulated in and impregnated with asphalt). Shinglet tear is characterized using Elmendorf tear tester ASTM D1922.

Figure 2:
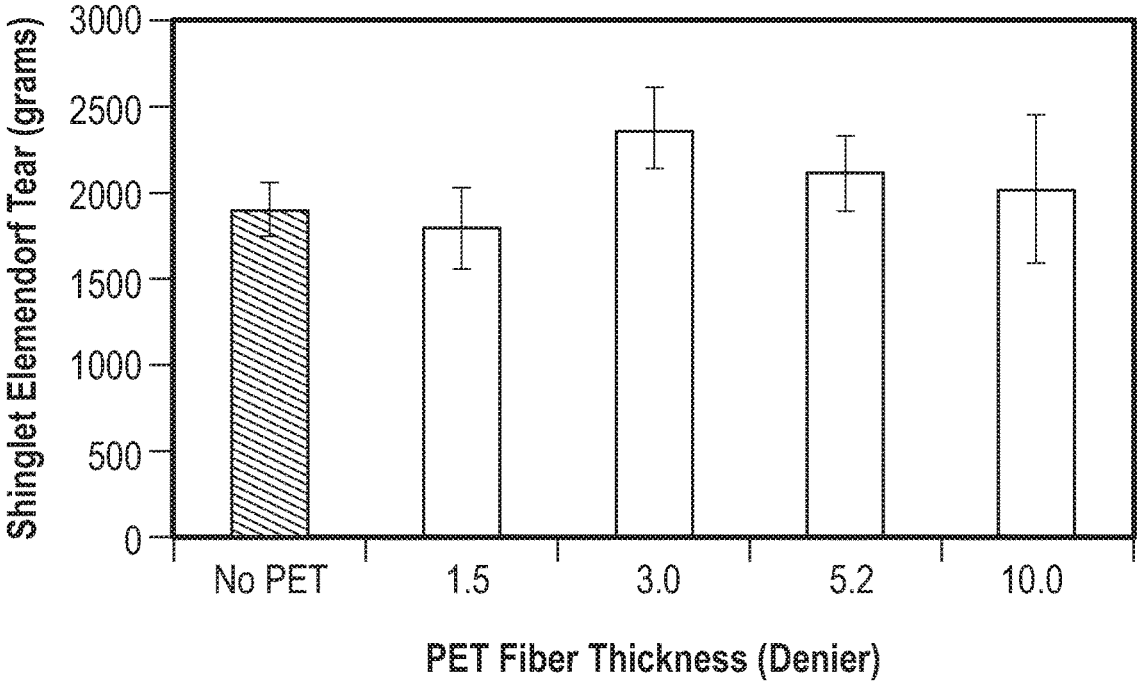
FIG. 2 includes a graphical depiction of tear strength for a shinglet containing a homogenously blended glass/polymer fiber mat with varying fiber thickness.

For the results in FIG. 2, all PET fibers are ¾ inch in length and loaded at 10% by weight of fibers in the sheet. As seen in FIG. 2, the effect of large denier (10.0 denier) resulting in lower shinglet tear performance can clearly be seen. Further the 3.0 denier PET fiber has a noticeable improvement of shinglet tear compared to a lower denier of 1.0 and higher denier of 5.0 and 10.0.

Figure 3:
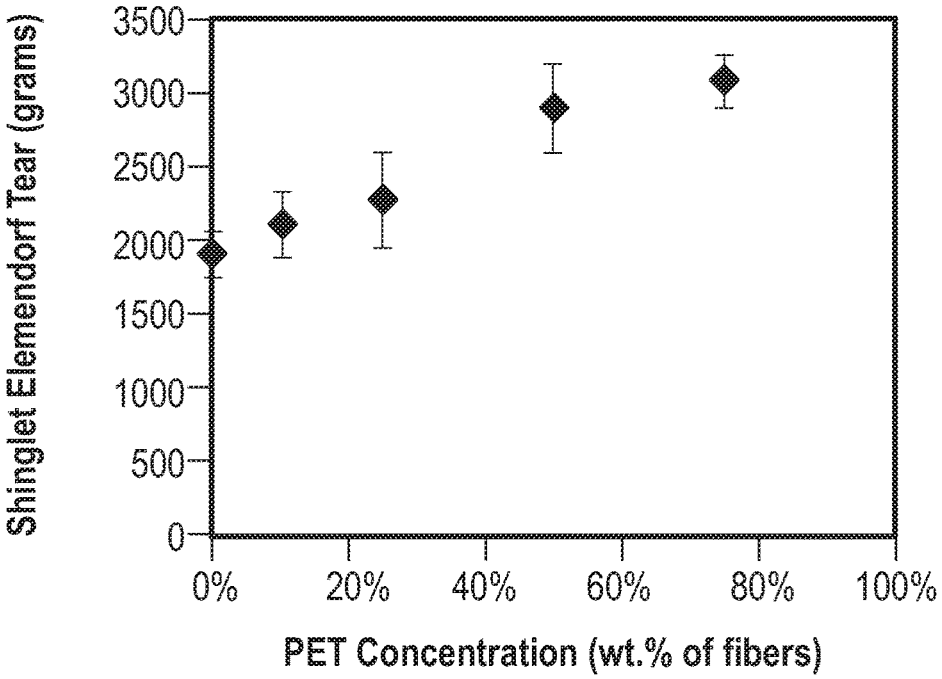
FIG. 3 includes a graphical depiction of tear strength for a shinglet containing a homogenously blended glass/polymer fiber mat with varying polymer fiber concentration.

With respect to FIG. 3, the concentrations shown are the percentages of the total fiber content that is PET, not the total weight of the mat. With FIG. 3, all PET fibers are ¾ inch in length and 5.2 denier. As seen in FIG. 3, blending greater amounts of PET into the fiber mat increases the tear of the shinglet.

Example 2

Figure 4:
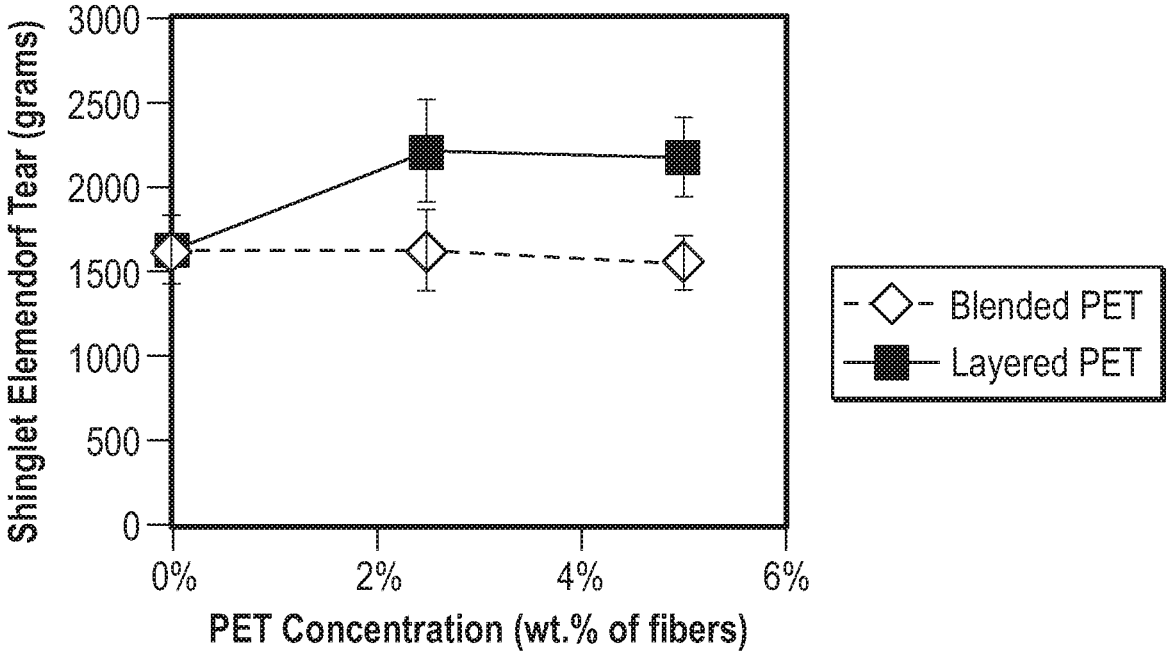
FIG. 4 includes a graphical depiction of tear strength for a shinglet containing a layered polymer/glass fiber mat compared to a homogenously blended glass/polymer fiber mat with varying polymer fiber concentration.

Hand sheets are constructed in the lab to a fiber weight of 1.46 lbs/100 $ft^2$ and then 0.39 lbs/100 $ft^2$ of binder is added to create a 21% LOI hand sheet with a total weight of 1.85 lbs/100 $ft^2$. In a normal hand sheet, all of the fibers are glass, but in this Example part of the glass weight is substituted with PET fibers. The concentrations shown in FIG. 4 are the percentages of the total fiber content that is PET, not the total weight of the mat. FIG. 4 compares having the PET homogenously blended with the glass versus the PET being layered on top of glass fibers. This Example uses 4 denier PET fibers that are ¾ inch in length. Shinglets are formed and tested for tear strength using the method described in Example 1.

FIG. 4 shows that the fiber mat having layered PET on one side of glass fibers gives a greater increase of tear strength compared to a homogenously blended PET/glass fiber mat.

Example 3

Hand sheets are constructed in the lab to a fiber weight of 1.46 lbs/100 $ft^2$ and then 0.39 lbs/100 $ft^2$ of binder is added to create a 21% LOI hand sheet with a total weight of 1.85 lbs/100 $ft^2$. In a normal hand sheet, all of the fibers are glass, but in this Example part of the glass weight is substituted with PET fibers. All of the hand sheets made in this Example contained 2.5 wt. % PET (on weight of fibers, not total weight) layered on top of glass fibers. Shinglets are formed and tested for tear strength using the method described in Example 1.

Figure 5:
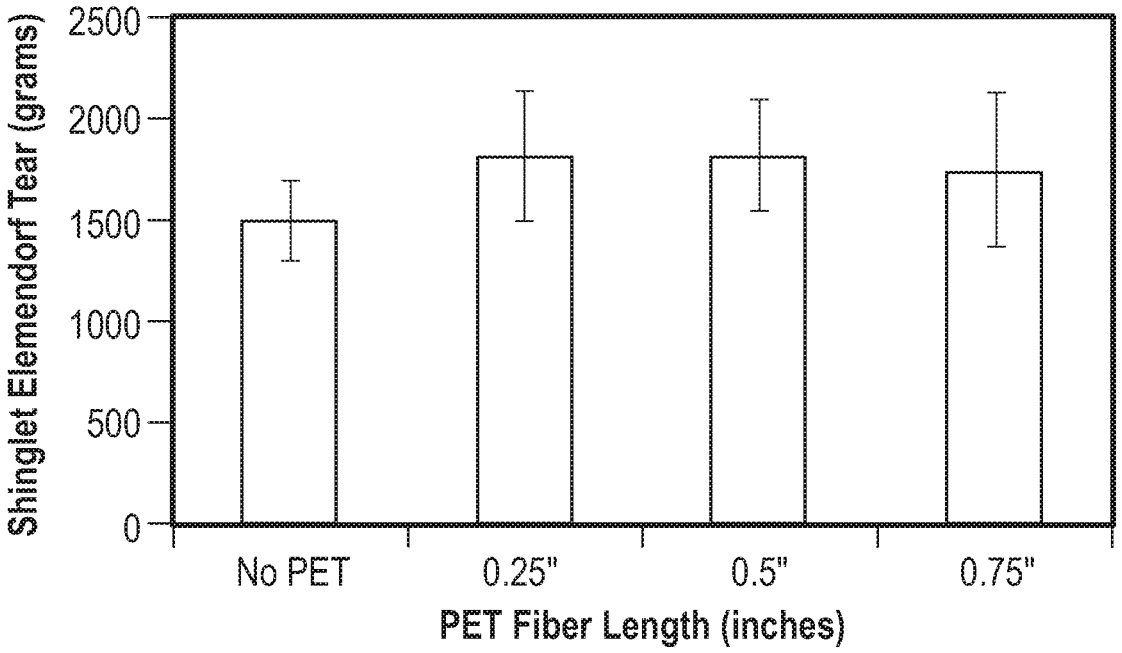
FIG. 5 includes a graphical depiction of tear strength for a shinglet containing a homogenously blended glass/polymer fiber mat with varying polymer fiber length.

FIG. 5 shows that while the PET is universally beneficial, there is no strong dependence on fiber length within these commercially available lengths.

Certain features, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A fiber mat comprises:

a nonwoven assembly of chopped fibers comprising a minority portion and a majority portion, the minority portion forming a first layer, the minority portion comprising a set of chopped polymer fibers and a majority portion forming a second layer, the majority portion comprising a set of chopped fibers different than the minority portion, wherein the minority portion is less than 10 weight % of a total composition of the fiber mat and wherein the majority portion is greater than 90 weight % of a total composition of the fiber mat; and a binder comprising an organic resin, wherein an air permeability of said fiber mat is not substantially different from an equivalent weight fiber mat containing a homogenous mat structure being homogenous in fiber distribution throughout the entirety of the mat, the homogenous mat structure comprising a homogenous blend of the chopped fibers of the minority portion and the chopped fibers of the majority portion and wherein the fiber mat provides at least a 5% increase in tear strength when placed in a bituminous roofing product compared to an equivalent bituminous roofing product made with the equivalent weight fiber mat containing the homogenous mat structure as measured by ASTM D1922; and at least one coating of asphalt.

2. The fiber mat of claim 1, wherein the fiber mat has an air permeability of at least 750 CFM/ft$^2$.

3. The fiber mat of claim 1, wherein the polymer fibers have a melting temperature ($T_m$) greater than about 200° C.

4. The fiber mat of claim 3, wherein the polymer fibers comprise polyester, polyethylene terephthalate, polyvinyl alcohol (PVA), polyvinyl chloride (PVC), polyether ether ketone (PEEK), polyether ketone (PEK), polyacrylonitrile, polystyrene, nylon, polymethyl methacrylate (PMMA), polybenzimidazole (PBI), polyimide, polyether imide (PEI), polyamide-imide (PAI), polyether sulfone (PES), polyphenyl sulfone (PPSU), polyphenylsulfide (PPS), liquid crystal polymer (LCP), ethylene tetrafluoroethylene (ETFE), polytetrafluoroethylene (PTFE), perfluoroalkoxy alkane (PFA), a blend, or combination thereof.

5. The fiber mat of claim 4, wherein the polymer fibers comprise polyethylene terephthalate.

6. The fiber mat of claim 1, wherein the polymer fibers are present at an amount of about 0.5 weight % to about 10 weight % —of the total weight of the assembly of fibers.

7. The fiber mat of claim 1, wherein the minority portion is directly in contact with the majority portion at an interface, wherein the interface has a substantially distinct segregation between the minority portion and the majority portion.

8. The fiber mat of claim 1, wherein a center plane of the minority portion is closer in distance to one surface of the fiber mat.

9. The fiber mat of claim 1, wherein a center plane of the minority portion is approximately coincident to a center plane of the fiber mat.

10. The fiber mat of claim 1, wherein the minority portion comprises a substantially random orientation of chopped fibers.

11. The fiber mat of claim 1, wherein the majority portion comprises a substantially random orientation of chopped fibers.

12. The fiber mat of claim 1, wherein the set of fibers of the majority portion comprises a glass fiber, a polymer fiber, a basalt fiber, a mineral fiber, or combination thereof.

13. The fiber mat of claim 1, wherein the binder is substantially uniformly distributed throughout the fiber mat.

14. The fiber mat of claim 1, wherein the fiber mat has a tensile strength at least 80% of a value of tensile strength of a fiber mat of equivalent weight containing the homogenous mat structure.

15. The fiber mat of claim 1, wherein the fiber mat has a tensile strength at least 80% of a value of tensile strength of a higher caliper fiber mat having the homogenous mat structure.

16. The fiber mat of claim 1, wherein a bituminous roofing product comprising the fiber mat has a tear strength at least 80% of a value of tear strength of an equivalent bituminous roofing product comprising a higher caliper fiber mat having a homogenous mat structure.

17. A bituminous roofing product comprises a fiber mat comprising a nonwoven assembly of chopped fibers comprising a minority portion and a majority portion, the minority portion forming a first layer, the minority portion comprising a set of chopped polymer fibers and a majority portion forming a second layer, the majority portion comprising a set of chopped fibers different than the minority portion, wherein the minority portion is less than 10 weight % of a total composition of the fiber mat and wherein the majority portion is greater than 90 weight % of a total composition of the fiber mat; and a binder comprising an organic resin, wherein an air permeability of said fiber mat is not substantially different from an equivalent weight fiber mat containing a homogenous mat structure being homogenous in fiber distribution throughout the entirety of the mat, the homogenous mat structure comprising a homogenous blend of the chopped fibers of the minority portion and the chopped fibers of the majority portion and wherein the fiber mat provides at least a 5% increase in tear strength when placed in a bituminous roofing product compared to an equivalent bituminous roofing product made with the equivalent weight fiber mat containing the homogenous mat structure as measured by ASTM D1922; and at least one coating of asphalt.

18. The bituminous roofing product of claim 17, wherein the asphalt substantially impregnates a plurality of interstices between the assembly of fibers.

* * * * *